US005108471A

United States Patent [19]

Poborsky

[11] Patent Number: 5,108,471

[45] Date of Patent: Apr. 28, 1992

[54] SINGLE MODE WET AND DRY VACUUM VEHICLE

[76] Inventor: Gary A. Poborsky, R.D. #2, Box 364, Johnstown, Pa. 15904

[21] Appl. No.: 702,090

[22] Filed: May 17, 1991

[51] Int. Cl.[5] ..... B01D 45/12; B01D 40/04

[52] U.S. Cl. ..... 55/186; 55/201; 55/302; 55/337; 55/346; 55/429

[58] Field of Search ..... 55/186, 201, 301, 318, 55/337, 345-349, 429, 467

[56] References Cited

U.S. PATENT DOCUMENTS

| | | | |
|---|---|---|---|
| 3,052,908 | 9/1962 | Daneman | 15/340 |
| 3,193,867 | 7/1965 | Daneman et al. | 15/314 |
| 3,404,776 | 10/1968 | Shaddock | 209/135 |
| 3,406,423 | 10/1968 | Young | 15/340 |
| 3,535,851 | 10/1970 | Riemsloh | 55/294 |
| 3,842,461 | 10/1974 | Wurster | 15/326 |
| 3,870,489 | 3/1975 | Shaddock | 55/314 |
| 3,885,932 | 5/1975 | Moore, Jr. et al. | 55/314 |
| 3,973,935 | 8/1976 | Moore, Jr. et al. | 55/302 |
| 4,062,664 | 12/1977 | Dupre et al. | 55/319 |
| 4,134,174 | 1/1979 | Flynn et al. | 15/302 |
| 4,162,149 | 7/1979 | Mekelburg | 55/315 |
| 4,218,226 | 8/1980 | Boozer | 55/274 |
| 4,227,893 | 10/1980 | Shaddock | 55/97 |
| 4,283,205 | 8/1981 | Schumann | 55/128 |
| 4,509,963 | 4/1985 | Jackson | 55/324 |
| 4,574,420 | 3/1986 | Dupre | 15/331 |
| 4,578,840 | 4/1986 | Pausch | 15/340 |
| 4,908,814 | 3/1990 | Sisk | 55/304 |
| 4,935,984 | 6/1990 | Bryant et al. | 15/302 |
| 4,946,483 | 8/1990 | Coral | 55/323 |
| 5,002,595 | 3/1991 | Kehy | 55/337 X |

*Primary Examiner*—Charles Hart

*Attorney, Agent, or Firm*—Webb, Burden, Ziesenheim & Webb

[57] ABSTRACT

A vacuum filtration and collection system operates in a single mode to remove both wet and dry debris from an air stream. The system includes a rectangular material holding receptacle, including a central main compartment surrounded by a cyclone separator compartment on one side and a bag filter compartment on the other side. The cyclone separators, which receive flows from the main compartment, have a tapered inlet plenum associated therewith. The air stream will flow from the cyclone separators through a tranverse duct to a bag inlet chute having an outlet below the bottom of the bag filters. The transverse duct is connected to the cyclone outlet plenum on at least opposite sides of an immediately adjacent cyclone separator.

20 Claims, 5 Drawing Sheets

SINGLE MODE WET AND DRY VACUUM VEHICLE

BACKGROUND OF THE INVENTION

1. Field of the Invention

This invention relates to a debris collection apparatus and, more particularly, to a vacuum type filtration and collection system which can collect both wet and dry debris.

2. Description of the Prior Art

Vacuum debris collecting devices are well known in the art. These devices typically include a main receptacle for storing the collected debris, a vacuum pump or the like for creating a vacuum in the receptacle, and an intake hose for drawing the debris into the receptacle. Most vacuum devices rely on gravity as a primary means for separating the debris, but other devices rely additionally on cyclone filters, bag filters, and the like for separating particulate matter of varying sizes from the collected debris.

Vacuum debris collection systems are often mounted on vehicles and are used for collecting debris from a wide range of sources, including mines, power plants, grain storage vessels, industrial plants, sewers, and the like. Such locations present a wide variety of debris to be collected, ranging from small, fine dust particles, to larger particles, to liquid debris, and to a combination of all types. Normally a vacuum vehicle is driven to a pickup site where the debris is drawn into the storage receptacle. The vehicle is then driven to a dump site where the contents of the receptacle are removed.

Many locations generating debris do not require cleanup on a daily basis. For this reason, it is common for vacuum vehicles to travel from one site to another, either on subsequent days or within the same day. Since some of the known vacuum vehicles are not particularly suited for collecting one type of debris or another, such as fine, dry particulate matter or liquid material, it is necessary that a suitable vehicle be dispatched to the location in accordance with the debris to be collected It is also known to provide a vacuum truck with multiple capacities which can be selected for the debris to be collected. For example, a control switch can be activated to configure the vacuum vehicle appropriate to collect dry debris or wet debris.

The prior art known to applicant in this area includes the following U.S. Pat. Nos. 3,052,908; 3,193,867; 3,404,776; 3,406,423; 3,535,851; 3,842,461; 3,870,489; 3,885,932; 3,973,935; 4,062,664; 4,134,174; 4,162,149; 4,218,226; 4,227,893; 4,283,205; 4,509,963; 4,574,420; 4,578,840; 4,909,814; 4,935,984; and 4,946,483.

One of the problems with the prior art vacuum systems is that a decision may need to be made on the mode of operation for the system depending on the type of debris to be collected. If the wrong choice is made, such as selecting the dry mode when wet debris is collected, certain parts of the system may be damaged. This is a particular concern when bag filters are used in the system and moisture laden debris contacts the bags. The bags can either be clogged to a point where they cannot be used until they dry out, or the bags could become ruined. In addition, the use of a control switch forces the operator to make a decision each time debris is to be collected. Finally, regardless of the mode selected, the nature of the debris may unexpectedly change while it is being collected, resulting in damage to the system.

Therefore, it is an object of the present invention to provide a vacuum system which can collect both wet and dry debris in a single mode of operation. It is another object of this invention to provide such a vacuum system in an arrangement which prevents moisture from reaching a series of bag filters. Furthermore, it is an object of the present invention to provide a vacuum system which has improved debris separation abilities so that only dry, fine particles remain in the air stream when it reaches the bag filters.

SUMMARY OF THE INVENTION

Accordingly, I have invented a single mode wet and dry vacuum system which includes an elongated material holding compartment having a rectangular cross section and preferably mounted to a vehicle frame. The material holding compartment includes a central, rectangular main compartment, a separator compartment extending along one side of the main compartment and a bag filter compartment extending along the other side of the main compartment. The separator compartment includes a bank of cyclone separators and the bag filter compartment includes a bank of bag filters. The main compartment includes an intake port through a top wall adjacent one end thereof and an intake hose connected to the intake port. The main compartment also includes an outlet port through the top wall and spaced from the intake port and adjacent the other end thereof. The outlet port is connected at one end to an elongated inlet plenum which is connected to inlets of the cyclone separators by a plurality of tangential ducts. A cyclone outlet plenum is connected to outlets of the cyclone separators and a transverse duct extends from the cyclone outlet plenum across the top wall to the bag filter compartment. A bag inlet chute is connected to the transverse duct and extends downwardly into the bag filter compartment and has an outlet positioned below the bottom of the bag filters. The cyclone inlet plenum tapers to provide constant air flow therethrough. The transverse duct is connected to the cyclone outlet plenum at least on opposite sides of an immediately adjacent cyclone separator. Means are provided on the vehicle for drawing a vacuum through, in turn, the bag filter compartment, bag inlet chute, transverse chute, cyclone outlet plenum, separator compartment, cyclone inlet plenum, main compartment and intake hose.

It is preferred that a hollow extension, extending downwardly from a bottom surface of the top wall, surround the outlet port in the main compartment. In addition, it is preferred that a baffle be included within the main compartment and extend downwardly from the top wall, stopping short of the bottom wall. The baffle is positioned between the intake and outlet ports. Open areas are provided at the corners of the baffle where it is connected to the top wall in order to improve air flows through the main compartment.

It is also advantageous to provide the tangential ducts with rectangular cross sections. Improved performance is noted when the inner surface of each of the cyclone separators is lined with an ultra high molecular weight type material. The transverse duct can be connected to the cyclone outlet plenum with a Y connecting duct having separate inlet openings positioned on opposite sides of an immediately adjacent cyclone separator. Preferably, the Y connector is positioned adjacent the middle most of the cyclone separators. In addition, the vacuum vehicle may also include a pulsator which provides periodic, short bursts of pressurized air above at least a portion of the bag filters to neutralize air flowing therefrom and permit particles adhering thereto to fall off the bag filters.

DESCRIPTION OF THE PREFERRED EMBODIMENTS

Figure 1:
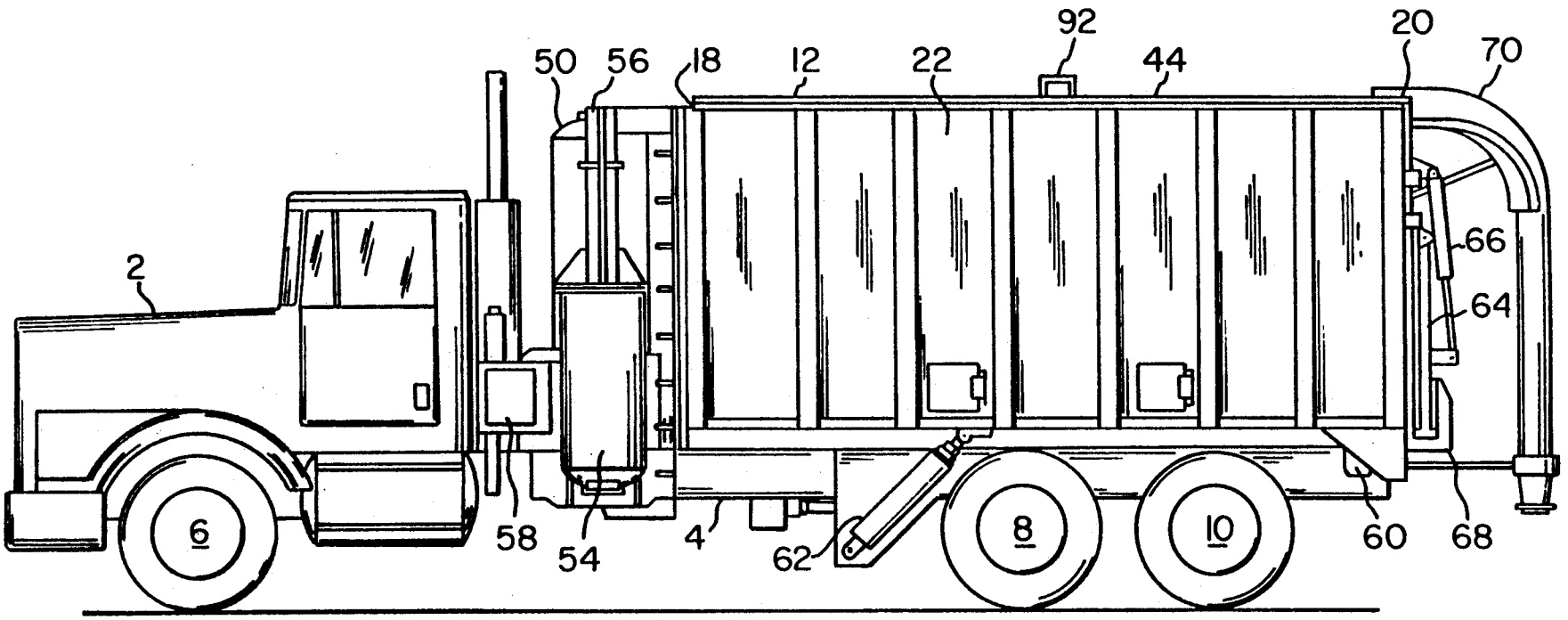
FIG. 1 is an elevational view of one side of a single mode vacuum vehicle in accordance with the present invention.
Figure 2:
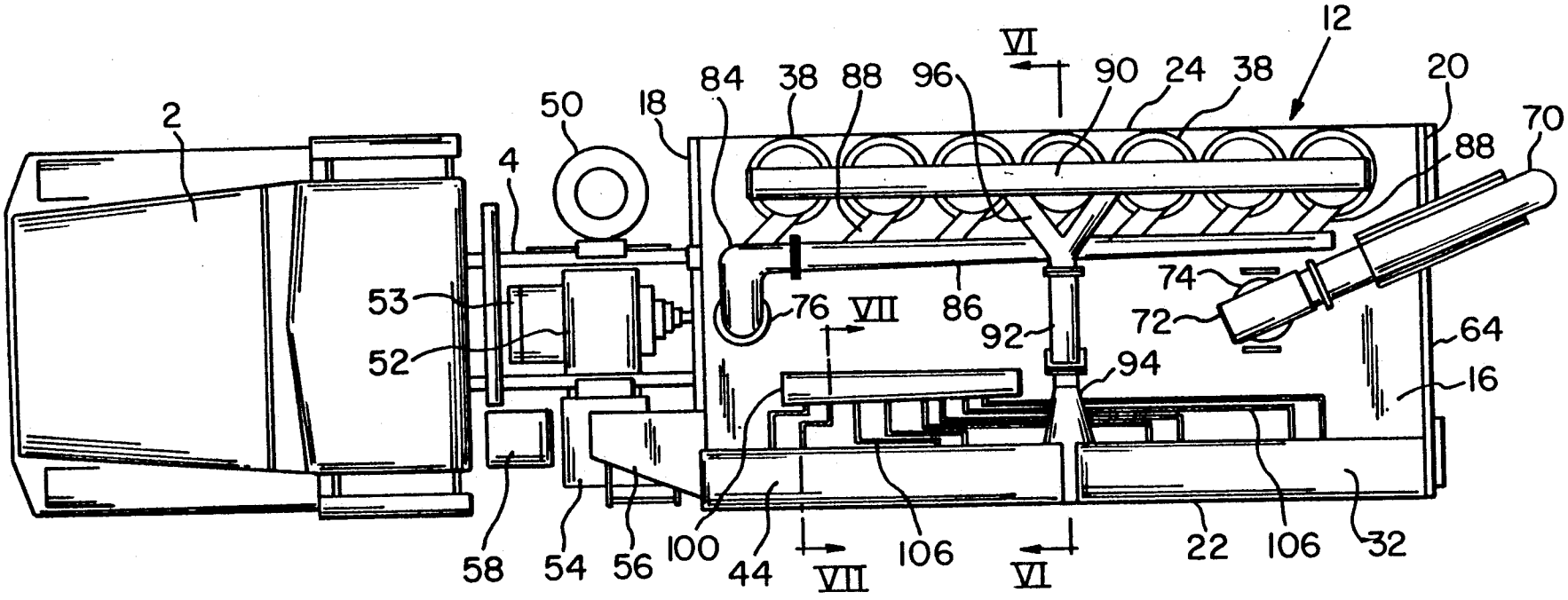
FIG. 2 is a top view of the vacuum vehicle shown in FIG. 1.
Figure 3:
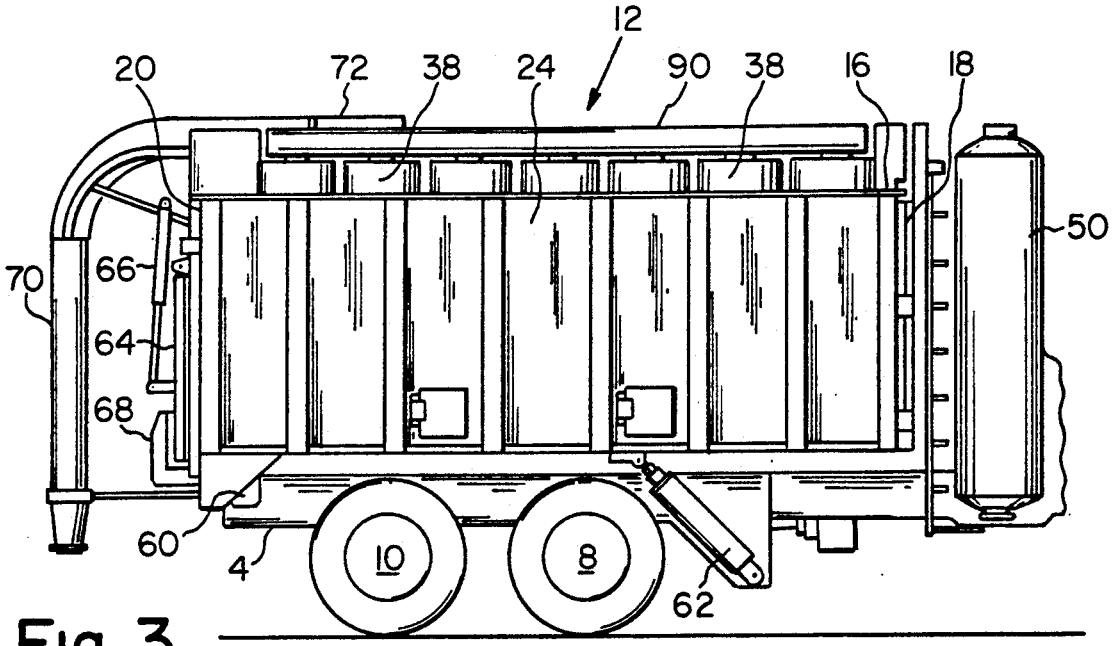
FIG. 3 is an elevational view of the rear portion of the other side of the vacuum vehicle shown in FIG. 1.
Figure 6:
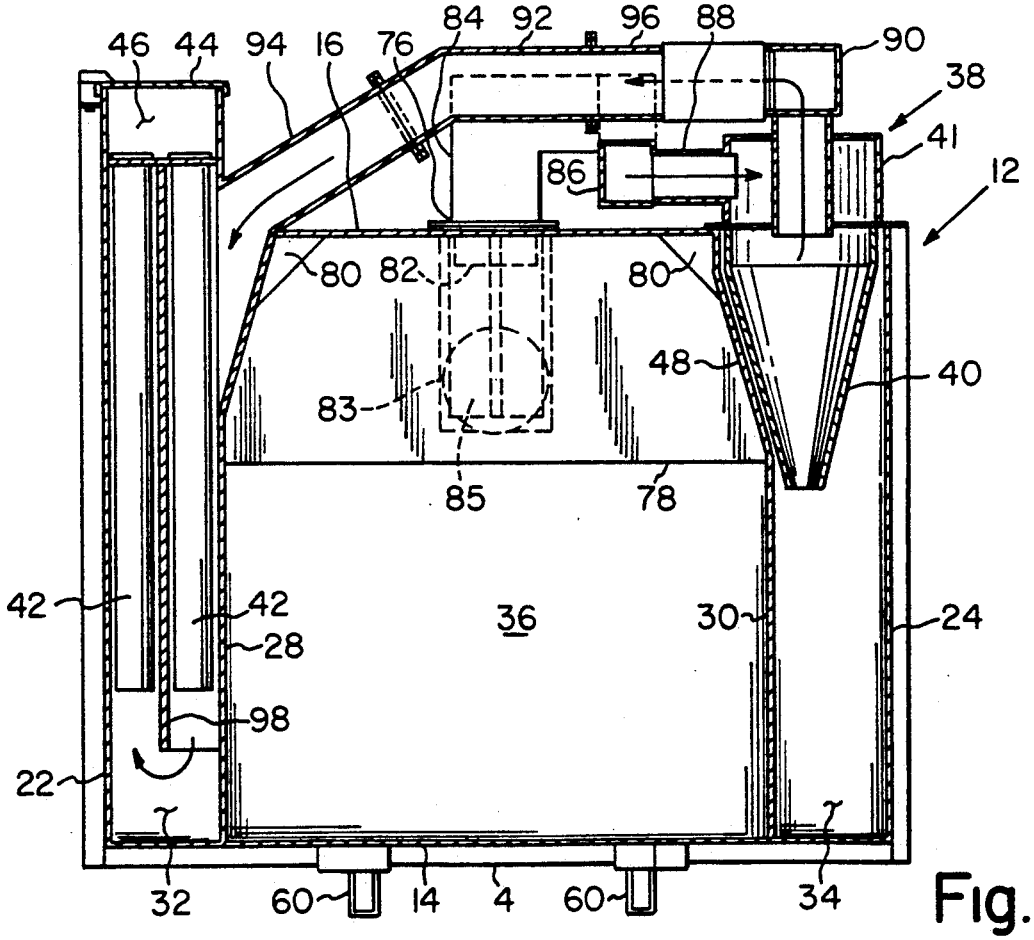
FIG. 6 is a section taken along lines VI—VI in FIG. 2.
Figure 4:
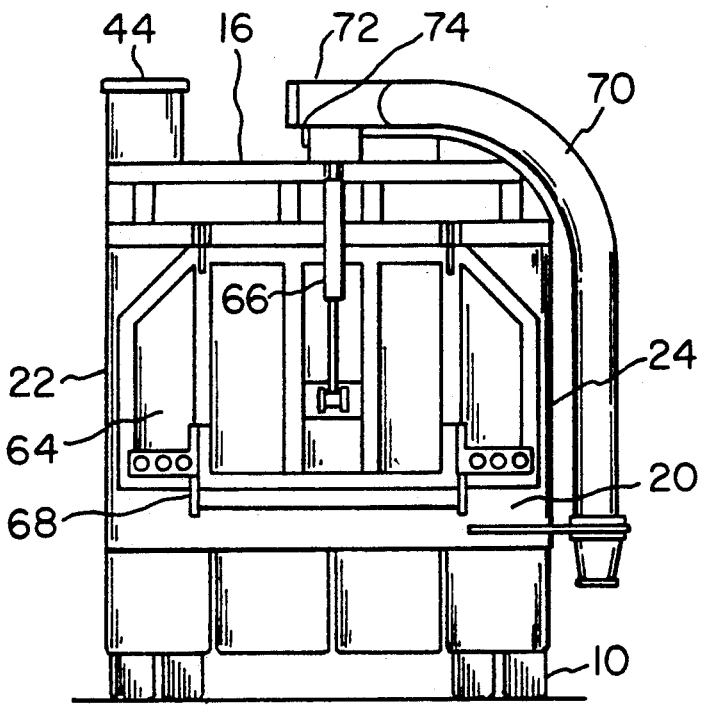
FIG. 4 is a rear view of the vacuum vehicle shown in FIG. 1.
Figure 7:
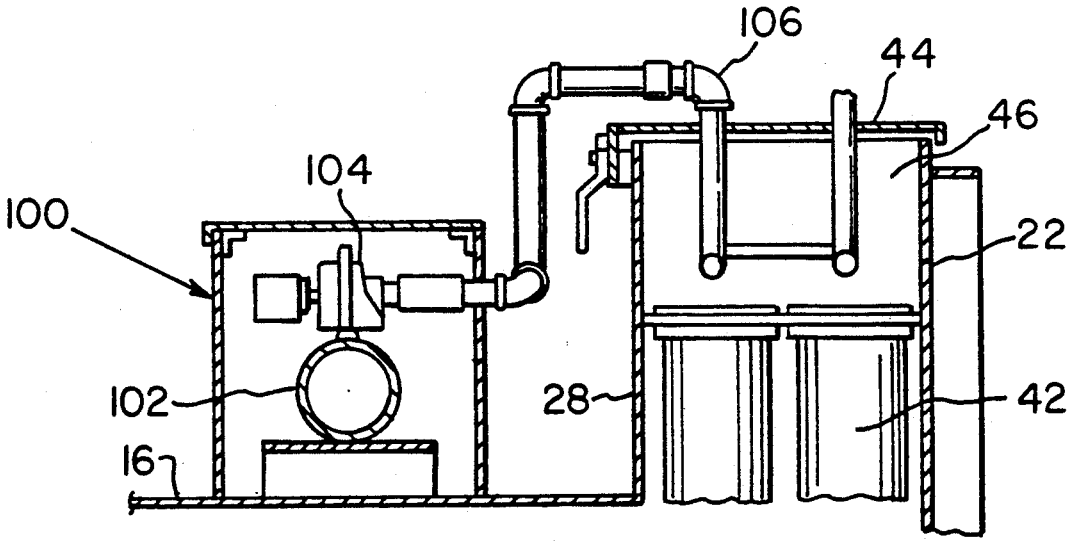
FIG. 7 is a section taken along lines VII—VII in FIG. 2.
Figure 5:
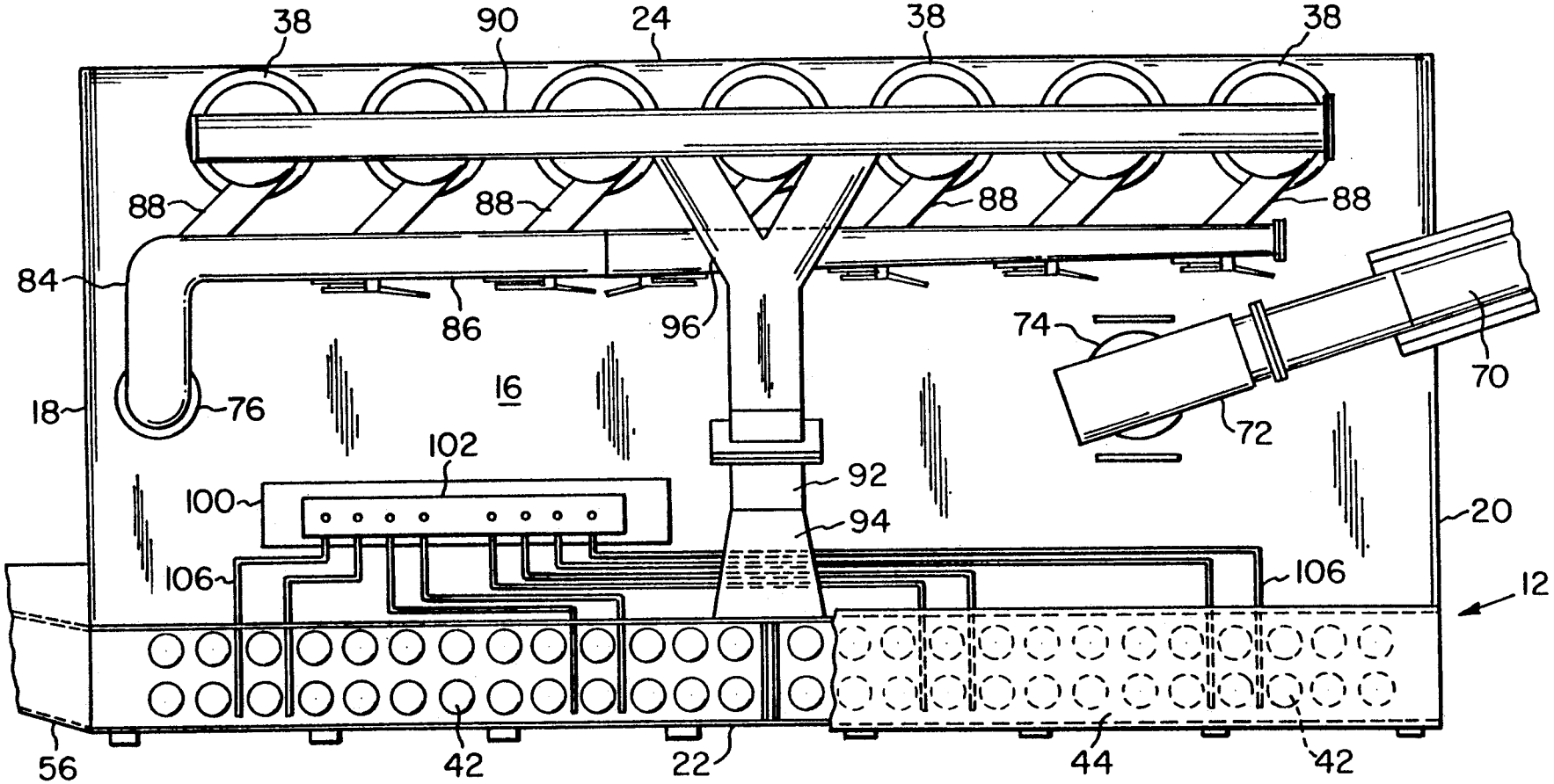
FIG. 5 is an enlarged top view, partially exposed, of the rear portion of the vacuum vehicle shown in FIG. 1.

A single mode wet and dry vacuum filtration and collection system in accordance with the present invention is shown in FIGS. 1-7. Although the invention is shown in a vacuum vehicle arrangement, the filtration and collection system could also be provided separate from a vehicle in a stationary configuration. The invention is shown mounted on a conventional vehicle including a driver's cab 2, and a frame 4 supporting a front axle unit 6 and dual rear axle units 8, 10. The vacuum system of the present invention is shown mounted onto the vehicle frame 4 in the area behind the driver's cab 2 and generally above the dual rear axle units 8, 10. The vacuum system includes an elongated material holding compartment 12 which is spaced from the rear of the driver's cab 2 and extends along and is supported by the vehicle frame 4.

The material holding compartment 12 is a hollow receptacle, basically rectangular in cross section, formed of a bottom wall 14, a top wall 16, a front wall 18, a rear wall 20 and opposed, outer side walls 22, 24. The material holding compartment 12 is divided into three compartments by a pair of opposed inner side walls 28 and 30 which are spaced from each other and spaced from the outer side walls 22, 24 and extend parallel thereto. Inner side wall 28 is positioned closer to outer side wall 22 and defines a bag filter compartment 32 therebetween. Similarly, inner side wall 30 is positioned closer to outer side wall 24 and defines a separator compartment 34 therebetween. A greater spacing remains between the inner side walls 28 and 30, which defines a main compartment 36 therebetween. The bag filter compartment 32 and the separator compartment 34 each extend along the length of the main compartment 36.

A bank of cyclone separators 38 are positioned in the upper portion of the separator compartment 34. Each cyclone separator 38 has a downwardly tapering cone portion 40 extending into said separator compartment 34 from an upper, circular portion 41. Similarly, a bank of dual bag filters 42 are positioned in the bag filter compartment 32. The upper portion of the bag filter compartment 32 extends above the top wall 16 of the material holding compartment 12 and is closed by a hinged top cover 44 which forms a bag filter outlet plenum 46 above the bag filters 42. As shown more clearly in FIG. 6, inner side wall 30 is tapered inwardly at an upper portion 48 to accommodate the cone portions 40 of the cyclone separators 38.

An exhaust stack 50, a vacuum pump 52, and a safety screen 54 are positioned between the driver's cab 2 and the front wall 18 of the material holding compartment 12 and are attached to the vehicle frame 4. The bag filter outlet plenum 46 is connected to a bag filter outlet duct 56 which directs air flows into the safety screen 54. The vacuum pump 52, which is driven by a transfer case connected to the drive train of the vehicle, is connected to the safety screen 54 and draws air therethrough from the bag filter compartment 32. The exhaust from the vacuum pump 52 is passed to the exhaust stack 50, which includes an internal silencer, and vents clean air to the atmosphere. A control panel 58 is positioned behind the cab 2 and adjacent the safety screen 54 to control the operation of the vacuum system.

The material holding compartment 12 is pivoted at a pair of pivot points 60 to a rear portion of the vehicle frame 4. A pair of hydraulic lifting cylinders 62 rotate the material holding compartment 12 about the pivot points 60. The rear wall 20 of the material holding compartment 12 has openings therethrough into the bag filter compartment 32, separator compartment 34 and main compartment 36. The openings in the rear wall 20 are closed by a rear door 64 which is opened by hydraulic cylinder 66 and which is securely closed by a locking mechanism 68. Debris collected in the three compartments 32, 34, 36 can be ejected by tilting the entire material holding compartment 12 about the pivot points 60 by the hydraulic lifting cylinders 62 and opening the rear door 64 by hydraulic cylinder 66.

Debris laden air is drawn into the main compartment 36 through an intake hose 70 which is joined to a connector 72 which, in turn, is connected to an intake port 74 through the top wall 16 thereof. It is preferred that the intake port 74 be positioned toward the rear wall 20 of the main compartment 36. An outlet port 76 is provided through the top wall 16 of the main compartment 36 at an end adjacent the front wall 18. In this manner, a greater distance of travel is provided for debris laden air as it travels through the main compartment 36 from the intake port 74 to the outlet port 76. This permits a majority of the debris to separate from the air stream from the force of gravity and be retained in the main compartment 36. In addition, it is preferred that a baffle 78 be positioned within the main compartment 36 in approximately the mid point thereof and extend downwardly from the top wall 16, between and contacting the inner side walls 28 and 30, ending about two-third the distance above the bottom wall 14. Small spaces or open areas 80 can be left where the baffle 78 meets the corners at the intersection of the top wall 16 and inner side walls 28, 30. These spaces 80 allow air to flow when debris in the main compartment 36 reaches the bottom of the baffle 78. In addition, a hollow cylindrical extension 82 can extend downwardly from the bottom surface of the top wall 16 within the main compartment 36 and surrounding the outlet port 76. Preferably, the extension 82 is formed by a portion of the associated duct penetrating through the top wall 16. By providing this cylindrical extension 82 about the outlet port 76, and by including the baffle 78, the debris laden air stream is forced to make several additional changes of direction in its flow from the intake port 74 and through the main compartment 36 to the outlet port 76. Each time the air stream changes direction, it provides additional force for the gravitational separation of the debris therefrom.

A safety shut-off can be provided for the outlet port 76 in the main compartment 36. As shown more clearly in FIG. 6, a framework 83, consisting of a plurality of spaced bars, extends downwardly from the top wall 16, surrounding the outlet port 76 and the outlet port extension 82. The framework 83 can also be attached to the front wall 18 for added strength. A floating ball 85 is positioned within the framework 83. If the liquid debris in the main compartment reaches a particularly high level, the ball 85 will float upward and close off the outlet port 76, and protect downstream elements in the system from damage. The lower portion of the outlet port extension 82 can be provided with a rubber seal to ensure a liquid tight fit of the ball 85.

After passing through the main compartment 36, the air stream with any remaining debris passes through the outlet port 76 and into an elbow connecting duct 84 which is joined to a cyclone inlet plenum 86. The cyclone inlet plenum 86 extends above the top wall 16 of the material holding compartment 12, generally parallel to the bank of cyclone separators 38. The cyclone inlet plenum 86 also tapers and becomes narrower as it extends away from the elbow duct 84 in order to continually increase the velocity of air flowing longitudinally therethrough and insure equal distribution of air to the cyclone separators 38 connected thereto. A tangential connecting duct 88 extends between the cyclone inlet plenum 86 and each cyclone separator 38. It is preferred that each tangential connecting duct 88 be formed of a square or rectangular cross section and have an outer or downstream wall which extends tangentially to the circular portion 41 of the cyclone separator 38. By providing a square or rectangular configuration to the tangential connecting duct 88, the air flow will be increased, the air flows will be more to the outer surface of the cyclone 38, and the cyclone 38 will work more efficiently.

Air is discharged from the top of each cyclone separator 38, at about the center of the circular portion 41, into an elongated cyclone outlet plenum 90 extending thereabove and substantially parallel to the cyclone inlet plenum 86. A transverse duct 92 extends from the cyclone outlet plenum 90 across the top wall 16 to a bag filter inlet connecting duct 94. The transverse conduit 92 is preferably joined to the middle of the cyclone outlet plenum 90 by a Y connecting duct 96 which has inlet openings on opposite sides of the immediately adjacent cyclone separator 38 and away from its center outlet. It is preferred that the inlets to the Y connecting duct 96 be located on opposite sides of the middle most of the cyclone separators 38 and between, but not above, the cyclone separators 38 immediately adjacent thereto. By providing such an arrangement, the air flow in the cyclone separator 38 adjacent the transverse duct 92 is not adversely affected and interfered with by the air flows from the other cyclone separators 38 through the transverse duct 92. The Y connecting duct 96 could also have a V shape, including one inlet opening extending from either side of the adjacent cyclone separators 38. In order to improve the efficiency of the cyclone separators 38, it is preferred that the inner surface of both the upper circular portion 41 and the lower cone portion 40 of each cyclone separator 38 be lined with an ultra high molecular weight type material, such as Solidur® 10100, made by Solidur Plastics Company, Delmont, Pa.

The bag inlet connecting duct 94 is, in turn, connected to a vertical bag inlet chute 98 which extends downwardly in the bag filter compartment 32 and has an outlet positioned below the bottom of the bag filters 42. This arrangement causes any moisture present in the air stream to drop along the sides of the bag inlet chute 98 and not enter the bag filters 42. In addition, the change of direction of the air stream as it exits the bottom of the bag inlet chute 98, which changes by approximately 180 degrees to flow into the bag filters 42, also aids in separating moisture and any larger debris particles from the air stream before it enters the bag filters 42. The bag filters 42 are preferably a bank of cylindrical cloth bags and are used to remove the remaining fine dust particles from the debris laden air stream.

It is also advantageous to include a pulsator 100 attached to the top wall 16 of the material holding compartment 12 for periodically jarring particles loose from the bag filters 42. One example of a pulsator 100 is shown more clearly in FIGS. 5 and 7. The pulsator 100 includes an elongated air manifold 102 which contains a supply of compressed air from either a compressor on the vacuum vehicle or from any known air source. A plurality of timed solenoid valves 104 are connected to the air manifold 102 and feed a series of air pipes 106 which extend into designated areas in the bag filter compartment 32. The outlets of the air pipes 106 are positioned in the bag filter outlet plenum 46 above the bag filters 42, with each individual bag filter 42 having an outlet from an air pipe 106 positioned thereabove. When a particular solenoid valve 104 is activated, compressed air travels from the air manifold 102 and through the air pipes 106 to an area immediately above a designated section of bag filters 42. This outflow of compressed air from the pulsator 100 neutralizes the air flow traveling into the bag filter 42 from the opposite side and for a short time allows particles adhering to the bag filters 42 to fall off into the bag filter compartment 32. It is preferred that small groups of bag filters 42, such as six or seven bags, be pulsated at one time. The remaining bag filters 42 are pulsated in sequence in these small groups. The sequence and timing of the pulsator 100 is directed by appropriate controls in the control panel 58.

The vacuum vehicle shown in FIGS. 1–7 operates in a single mode at all times. In particular, all of the debris laden air passes into the top of the main compartment 36 through the intake hose 70 and intake port 74. The debris laden air then passes through the main compartment 36 where a combination of gravity and the directional changes from the baffle 78 and the cylindrical extension 82 on the outlet port 76 separates the large majority of the debris, both wet and dry, from the air stream. The air stream then passes into the cyclone inlet plenum 86 and into the bank of cyclone separators 38 which will remove a large majority of the remaining dry and wet particles in the air stream. Typically, all of the wet debris will have been removed from the air stream by the time it passes through the cyclone separators 38. However, if any moisture does remain in the air stream, it will be removed as it passes through the transverse duct 92 and the bag inlet chute 98 before it reaches the bank of bag filters 42. Only dry debris remains in the air stream as it passes through the lo bag filters 42. The air stream then exits from the bag filters 42 through the bag filter outlet plenum 46, into the bag filter outlet duct 56 and into the safety screen 54 upstream of the vacuum pump 52. Only clean, dry air will pass through the vacuum pump 52 and out to the atmosphere through the exhaust stack 50.

By the present invention, an operator can travel from one job to the next and be in a position to remove any type of debris that may be encountered. The operator need not make any decision before collecting the debris as to whether the vehicle should be configured in a wet mode or a dry mode. In addition, there is no possibility that moisture will be accidentally drawn into the vacuum vehicle, when operating in a dry mode, and ruin the bag filters 42. Moreover, the improvement included in the present arrangement provides for a much more efficient and thorough separation of all debris from the air stream drawn into the vacuum vehicle. The rectangular cross section of the main debris compartment 12 provides for a large receiving compartment for the debris, provides for better air flow and debris removal, and also provides for a more stable and low height arrangement when compared with the known circular receptacles.

Having described above the presently preferred embodiments of this invention, it is to be understood that the invention may be otherwise embodied within the scope of the appended claims.

I claim:

1. A single mode wet and dry vacuum vehicle comprising: an elongated material holding compartment having a rectangular cross section and mounted to a vehicle frame, said material holding compartment including a central, rectangular main compartment, a separator compartment extending along one side of said main compartment, and a bag filter compartment extending along the other side of said main compartment, said separator compartment including therein a bank of cyclone separators and said bag filter compartment including therein a bank of bag filters, said main compartment including an intake port through a top wall adjacent one end thereof and an intake hose connected to said intake port, said main compartment also including an outlet port through said top wall and spaced from said intake port and adjacent the other end thereof, with said outlet port connected at one end to an elongated inlet plenum which, in turn, is connected to inlets of said cyclone separators by a plurality of tangential ducts, said vacuum vehicle further including a cyclone outlet plenum connected to outlets of said cyclone separators, a transverse duct extending from said cyclone outlet plenum and across said top wall to said bag filter compartment, and a bag inlet chute connected to said transverse duct and extending downwardly into said bag filter compartment and having an outlet below the bottom of said bag filters therein, with said cyclone inlet plenum tapering and narrowing away from said outlet port to provide constant air flow therethrough, and with said transverse duct connected to said cyclone outlet plenum at least on opposite sides of an immediately adjacent cyclone separator, and with said vacuum vehicle further including means for drawing a vacuum through, in turn, said bag filter compartment, bag inlet chute, transverse chute, cyclone outlet plenum, separator compartment, cyclone inlet plenum, main compartment and intake hose.

2. The vacuum vehicle of claim 1 further including a hollow extension surrounding said outlet port in said main compartment and extending downwardly from a bottom surface of said top wall.

3. The vacuum vehicle of claim 1 further including a baffle within said main compartment and extending downwardly from said top wall, but stopping short of said bottom wall, with said baffle positioned between said intake and outlet ports.

4. The vacuum vehicle of claim 3 further including open areas at the corners of said baffle where it is connected to said top wall.

5. The vacuum vehicle of claim 1 wherein said tangential ducts have rectangular cross sections.

6. The vacuum vehicle of claim 1 wherein an inner surface of each of said cyclone separators is lined with an ultra high molecular weight type material.

7. The vacuum vehicle of claim 1 wherein said transverse duct is connected to said cyclone outlet plenum with a Y connecting duct having separate inlet openings positioned on opposite sides of an immediately adjacent cyclone separator.

8. The vacuum vehicle of claim 7 wherein said Y connector is positioned adjacent the middle most of said cyclone separators.

9. The vacuum vehicle of claim 1 further including a pulsator which provides periodic, short bursts of pressurized air above at least a portion of said bag filters to neutralize air flowing therefrom and permit particles adhering thereto to fall off said bag filters.

10. The vacuum vehicle of claim further including a hollow extension surrounding said outlet port in said main compartment and extending downwardly from a bottom surface of said top wall and further including a baffle within said main compartment and extending downwardly from said top wall, but stopping short of said bottom wall, with said baffle positioned between said intake and outlet ports.

11. The vacuum vehicle of claim 10 further including open areas at the corners of said baffle where it is connected to said top wall.

12. The vacuum vehicle of claim 10 wherein said tangential ducts have rectangular cross sections.

13. The vacuum vehicle of claim 10 wherein an inner surface of each of said cyclone separators is lined with an ultra high molecular weight type material.

14. The vacuum vehicle of claim 10 wherein said transverse duct is connected to said cyclone outlet plenum with a Y connecting duct having separate inlet openings positioned on opposite sides of an immediately adjacent cyclone separator.

15. The vacuum vehicle of claim 14 wherein said Y connector is positioned adjacent the middle most of said cyclone separators.

16. The vacuum vehicle of claim 10 further including a pulsator which provides periodic, short bursts of pressurized air above at least a portion of said bag filters to neutralize air flowing therefrom and permit particles adhering thereto to fall off said bag filters.

17. A vacuum filtration and collection system comprising: an elongated material holding compartment having a rectangular cross section, said material holding compartment including a central, rectangular main compartment, a separator compartment extending along one side of said main compartment, and a bag filter compartment extending along the other side of said main compartment, said separator compartment including therein a bank of cyclone separators and said bag filter compartment including therein a bank of bag filters, said main compartment including an intake port through a top wall adjacent one end thereof and an intake hose connected to said intake port, said main compartment also including an outlet port through said top wall and spaced from said intake port and adjacent the other end thereof, with said outlet port connected at one end to an elongated inlet plenum which, in turn, is connected to inlets of said cyclone separators by a plurality of tangential ducts, said system further including a cyclone outlet plenum connected to outlets of said cyclone separators, a transverse duct extending from said cyclone outlet plenum and across said top wall to said bag filter compartment, and a bag inlet chute connected to said transverse duct and extending downwardly into said bag filter compartment and having an outlet below the bottom of said bag filters therein, with said cyclone inlet plenum tapering and narrowing away from said outlet port to provide constant air flow therethrough, and with said transverse duct connected to said cyclone outlet plenum at least on opposite sides of an immediately adjacent cyclone separator, and with said system further including means for drawing a vacuum through, in turn, said bag filter compartment, bag inlet chute, transverse chute, cyclone outlet plenum, separator compartment, cyclone inlet plenum, main compartment and intake hose.

18. The vacuum filtration and collection system of claim 17 further including a hollow extension surrounding said outlet port in said main compartment and extending downwardly from a bottom surface of said top wall.

19. The vacuum filtration and collection system of claim 17 further including a baffle within said main compartment and extending downwardly from said top wall, but stopping short of said bottom wall, with said baffle positioned between said intake and outlet ports.

20. The vacuum filtration and collection system of claim 19 further including open areas at the corners of said baffle where it is connected to said top wall.

* * * * *

UNITED STATES PATENT AND TRADEMARK OFFICE

CERTIFICATE OF CORRECTION

PATENT NO. : 5,108,471

DATED : April 28, 1992

INVENTOR(S) : Gary A. Poborsky

It is certified that error appears in the above-identified patent and that said Letters Patent is hereby corrected as shown below:

On the Title page, item [56], U.S. Patent Documents,

"4,908,814 3/1990 Sisk ... 55/304" should read --4,909,814 3/1990 Sisk ... 55/304--.

Column 1 Line 42 after "collected" insert --.--.

Column 6 Line 64 "lo bag" should read --bag--.

Claim 10 Line 25 Column 8 after "claim" insert --1--.

Signed and Sealed this

Twentieth Day of July, 1993

*Attest:*

Michael K. Kirk

MICHAEL K. KIRK

*Attesting Officer*

*Acting Commissioner of Patents and Trademarks*